United States Patent [19]
Harris et al.

[11] Patent Number: 4,629,090
[45] Date of Patent: Dec. 16, 1986

[54] HOTEL ROOM BAR WITH OPTICAL SENSING SYSTEM

[75] Inventors: Frank Harris, St. Albans; Lyn Roberts, London, both of England

[73] Assignee: Robobar Limited, Greenford, England

[21] Appl. No.: 573,843

[22] Filed: Jan. 24, 1984

[51] Int. Cl.[4] ..... G07F 11/00
[52] U.S. Cl. ..... 221/7; 221/150 R; 221/194; 221/289; 340/286 R; 350/96.18
[58] Field of Search ..... 221/2, 4, 6, 7, 8, 191, 221/193, 194, 197, 155, 92, 150 R, 151, 152, 255-257, 285, 289, 129; 186/35, 52; 350/96.18; 340/568, 825.34, 286 R, 286 M; 358/86; 194/1 N; 133/2, 4, 5

[56] References Cited

U.S. PATENT DOCUMENTS

| | | | |
|---|---|---|---|
| 2,708,747 | 5/1955 | Moon | 340/568 |
| 3,310,198 | 3/1967 | Regan et al. | 221/7 |
| 3,410,385 | 11/1968 | Freet et al. | 221/155 X |
| 3,737,070 | 6/1973 | O'Neal | 221/6 |
| 3,743,137 | 7/1973 | Bennett | 221/289 |
| 3,749,279 | 7/1973 | Ungerman | 221/7 |
| 3,757,225 | 9/1973 | Ulicki | 358/86 X |
| 3,852,737 | 12/1974 | Gordon | 221/4 X |
| 3,884,386 | 5/1975 | Urcola | 221/7 |
| 4,194,647 | 3/1980 | Spurrier | 221/197 X |
| 4,369,442 | 1/1983 | Werth et al. | 194/1 N X |
| 4,531,810 | 7/1985 | Carlsen | 350/96.18 X |

FOREIGN PATENT DOCUMENTS

| | | | |
|---|---|---|---|
| 2636610 | 2/1977 | Fed. Rep. of Germany | 221/2 |

*Primary Examiner*—Joseph J. Rolla
*Assistant Examiner*—Edward S. Ammeen
*Attorney, Agent, or Firm*—James D. Fornari; Ivor M. Hughes

[57] ABSTRACT

A bar has at least one compartment, a plurality of removeable magazines mounted in the compartment, fiber optics associated with the bar compartment and each magazine for assisting to detect the removal of a magazine from the bar compartment and the removal and/or movement of the contents of the magazine. The fiber optics comprise:

(a) optical fibers secured to each magazine and lenses secured to the optical fibers on each magazine; and
(b) lenses on the bar associated with the compartment. Some of the lenses on each magazine are spaced from, and aligned with, some of the lenses on the same magazine for the transmission of light therebetween, and some of the lenses on each magazine are spaced from, and aligned with, some of the lenses on the bar associated with the compartment for the transmission of light therebetween. The lenses of each magazine which are spaced from, and aligned with, other lenses of the same magazine are secured by optical fibers to lenses spaced from, and aligned with, lenses on the bar associated with the compartment. Each magazine comprises a housing closed by an access door which permits access to and dispensing of only one item from the magazine at a time when the door is opened. The opening of the door causes interference with a beam of light transmitted between two spaced and aligned lenses of the same magazine permitting the leading item to be removed from the magazine.

171 Claims, 18 Drawing Figures

HOTEL ROOM BAR WITH OPTICAL SENSING SYSTEM

FIELD OF INVENTION

This invention relates to bars (for example, refrigerated bars) suitable for use in hotel rooms for dispensing soft drinks, comestibles liquor or beer in bottles and cans and packages, components for such bars, and components suitable for use with such bars.

BACKGROUND OF THE INVENTION

Stocked refrigerated bars are commonly provided in each hotel room of a hotel for ready access by the guest occupying the room to individual drink size, bottles of liquor, cans of beer soft drinks, or other comestibles in cans, bottles or other packaging.

Prior to the guest occupying the hotel room, the refrigerated bar has been replenished so that the bar has a full complement of beverages. At the time of check out by the guest, the bar must be checked by one of the hotel employees to determine the guest's acquisitions during his/her stay. To this end, an employee of the hotel attends at the room and counts the remaining bottles in the bar, reporting to the front desk, the number and types of "drinks" missing.

While electronic sensors and related electronic circuitry can be mounted in the bar, for detecting the removal of beverages from the storage magazines of the bar, and for transmitting that information to a central monitoring and processing system, the interconnection of all the electronic components (including wires extending from each magazine holding the beverages to the housing of the bar) would be awkward and difficult to handle. Additionally, in the refrigerated portions of the bar, the operation of the electronic components and circuitry would be affected by the cold and give phantom readings. Where special precautions are taken the structure would become more costly but still not alleviate all the deficiencies of this construction.

It is therefore an object of this invention to provide bars including refrigerated bars, and components therefor, all of simple yet reliable construction even in the refrigerated compartments.

It is a further object of this invention to provide bars, including refrigerated bars which are capable of being continuously and reliably monitored at a remote source, for example, the front or reception desk of a hotel.

It is a further object of this invention to provide such a bar comprising improved components which permit ease of removal and replacement of the magazines from the bars.

It is still a further object of this invention to provide individual storage magazines of improved construction which may be reliably monitored as to their contents, yet easily removed from the bar for refilling.

Further and other objects of the invention will be realized by those skilled in the art from the following summary of the invention and detailed description of embodiments thereof.

SUMMARY OF THE INVENTION

According to one aspect of the invention, a bar (in one embodiment, a refrigerated bar) and magazine suitable for use in such bar are provided, the bar comprising at least one compartment, a plurality of removable magazines in the at least one compartment, fiber optics associated with the at least one bar compartment and each magazine for assisting to detect the removal of a magazine from the at least one bar compartment and the removal and/or movement of the contents of the magazine, the fiber optics comprising:

(a) optical fibers secured to each magazine and lenses secured to the optical fibers on each magazine - and (b) lenses on the bar associated with the at least one compartment, some of the lenses on each magazine spaced from, and aligned with some of the lenses on the same magazine for the transmission of light therebetween, and some of the lenses on each magazine spaced from and aligned with, some of the lenses on the bar for the transmission of light therebetween, the lenses of each magazine which are spaced from, and aligned with, other lenses of the same magazine for the transmission of light therebetween, being secured by optical fibers to lenses spaced from, and aligned with, lenses on the bar associated with the at least one compartment for transmission of light therebetween.

According to another aspect of the invention, a magazine is provided suitable for use for removably securing in a bar, each magazine comprising fiber optics for assisting to detect the removal and/or movement of the contents of the magazine, the fiber optics comprising:

(a) optical fibers secured to each magazine and lenses secured to the optical fibers on each magazine some of the lenses on each magazine spaced from, and aligned with, some of the lenses on the same magazine for the transmission of light therebetween, the lenses of each magazine spaced from, and aligned with, other lenses of the same magazine for the transmission of light therebetween, being secured by the optical fibers to other lenses carried by the magazine to be spaced from, and aligned with, lenses of the bar in which the magazine is to be positioned, for the transmission of light therebetween.

Preferably, each lens "columnates" the beam of light transmitted therefrom. In this regard the beam is neither dispersed or focused over short distances but is transmitted as a "cylinder" of light.

Preferably, each lens is connected to each optical fiber employing the maximum gel material carried by the lens which gel material has the same refractive index as the lens and which material interfaces the lens and optical fiber.

Preferably the end of the optical fiber is polished.

According to another aspect of the invention, each magazine comprises a housing closed by an access door (preferably transparent door) which permits access to, and thus dispensing of, only one item (bottle, package or can) from the magazine at one time when the door is opened.

According to another aspect of the invention, the access door may be pivotable about a horizontal axis thereby rotating from a position closing the magazine, around the leading item (bottle, package or can) carried by the magazine and into the magazine behind the item isolating the leading item (bottle, package or can) from the remaining items in the magazine permitting access to only the leading item (bottle, package or can) by the guest.

According to another aspect of the invention, the bottom of each magazine is sloped downwardly from a position remote the access door towards the access door for causing bottles, package or cans in the magazine to roll or slide towards the access door.

According to another aspect of the invention, when the access door is rotated about the horizontal axis the action causes interference with a beam of light transmitted between two spaced and aligned lenses of the same magazine permitting the leading item of the magazine to be removed.

According to another aspect of the invention, when the leading item is removed and the access door closed to its original position, the next following item (bottles, packages or cans)rolls or slides forwardly as the case may be, towards the access door affecting the receipt or non-receipt of a beam of light transmitted by one lens of at least another pair of spaced and aligned lenses of the same magazine towards the other lens. When this interference and affect on the light beams occurs, the interference and effect is registered in a microprocessor (microcomputer) mounted on the bar. This registered information is in turn transmitted to a central monitoring system (including central processor) at the front hotel desk for storing and processing with respect to that bar, indicating for example, the removal of a magazine from the at least one bar compartment, the opening of the access door of a magazine the removal of the leading item and the movement of the following item in the magazine after the lead item is removed.

According to another aspect of the invention, the registered information transmitted from the microprocessor mounted on each bar to the monitoring system (including a central processor) may be transmitted along the co-axial television cable provided in the hotel room in which the bar is located.

According to another aspect of the invention, in its broadest aspects a bar carrying a microprocessor in a hotel room is connected to a central monitoring system at the front desk of a hotel (or other office) which system includes a central processor, via the co-axial television provided in the hotel room in which the bar is located.

In this regard, when the information, for example, the interference and effect of the light beams registered in the microprocessor is to be transmitted to the central monitoring system, the output of the microprocessor is converted to radio frequency output, (known as frequency shift keying [FSK] using one frequency for zero and another for one), and sent to the central monitoring system including the central processor via the co-axial cable leading from the hotel room whereat the output is reconverted to digital output before being inputted into the central monitoring system including the central processor.

To prevent the signals of the television and converted microprocessor signals from the bar from merging, a diplexor (filter) comprising a low-pass filter and high-pass filter is employed.

According to another aspect of the invention, a bar is provided comprising at least one compartment, a storage compartment in the bar, a microprocessor carried by the bar for the processing of information with respect to the contents of the bar, the microprocessor for being connected to a monitoring system including a central processor, by a co-axial television cable employing a diplexor for the transmission of information from the microprocessor to the monitoring system, the information being transmitted from the bar microprocessor, after conversion to radio frequency output to the monitoring system and being reconverted to digital output before being inputted into the monitoring system.

According to another aspect of the invention, a bar is provided comprising at least one compartment, a storage compartment in the bar carrying a plurality of storage magazines, a microprocessor carried by the bar, the microprocessor being connected to a monitoring system including a central processor, by a co-axial television cable employing a diplexor for the transmission of infromation from the microprocessor to the monitoring system, the information being transmitted from the bar microprocessor after conversion to radio frequency output to the monitoring system and being reconverted to digital output before being inputted into the monitoring system.

Preferably the bar, for example, refrigerated bar, comprises a number of magazines each having honeycomb construction for the circulation of refrigerated air and carrying a see-through access door for access to the contents and each magazine comprises a sloped bottom, sloped from a raised rear portion to a lower frontal portion proximate the access floor to ensure the following item (cylindrical liqour bottle, package or can) carried in each magazine is urged to roll or slide forwardly to the access door and does so when the leading bottle, package or can is removed and the access door closed. In the preferred embodiment each opening of the magazine door permits access to, and removal of, only the leading article. Therefore, once the leading item is removed and the door closed, the following item moves towards the access door and the next following item becomes the leading item. These events are all registered in the microprocessor and ultimately the central monitoring system via the co-axial cable.

The use of the fiber optics also permits the individual magazines to be mounted in the bar in appropriate position with no wire connections to enable the magazines to be removed, filled, and repositioned in the bar with minimal difficulty, requiring minimal expertise. Additionally, in the refrigerated bar because the sensing of the movement is by the use of fiber optics, there are no copper wires or microswitches to go wrong or give phantom readings arising from the cold. The optics on the other hand remain unaffected by disturbances in the electric current to the bar and by condensation in the bar.

Additionally, by the use of fiber optics, the opening and closing of the bar door itself can be made to be registered in the microprocessor of the bar, which information will be ultimately transmitted to the central monitoring system including central processor at for example, the hotel front desk.

Particularly, the bar wall surrounding the compartment may carry a pair of lenses, each connected to optical fibers, and the bar door carries on the inside thereof a reflective material and/or reflective plate whereby when the bar door is closed, the reflective material or reflective plate is so positioned so that light transmitted from one of the pair of lenses on the bar wall is reflected by the reflective material or reflective plate into the other lens when the bar door is closed. The receipt or non-receipt by the other lens of the light beam is registered by the microprocessor and this information is then transmitted to the monitoring system (including central processor) at the front desk.

The invention will now be illustrated having regard to the embodiments shown in the following drawings and described in the detailed description of the drawings that follows.

DETAILED DESCRIPTION OF THE EMBODIMENTS

Figure 1:
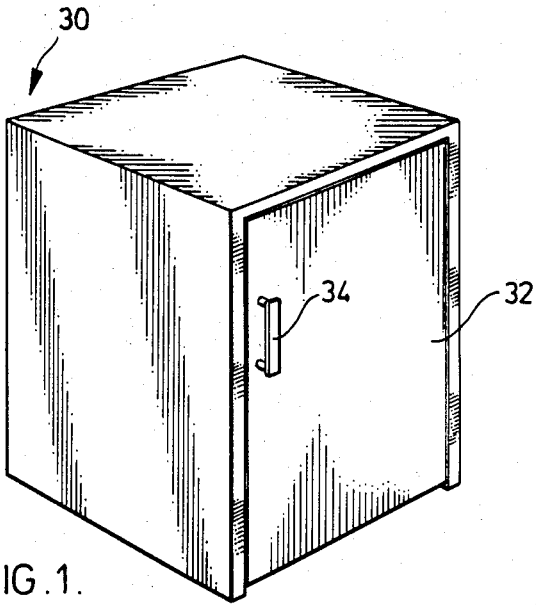
FIG. 1 is a perspective view of a refrigerated bar according to an embodiment of the invention.

With reference to FIG. 1 there is shown refrigerated bar 30 for use in individual hotel rooms of a hotel, each bar 30 comprising bar door 32 carrying handle 34.

Figure 2:
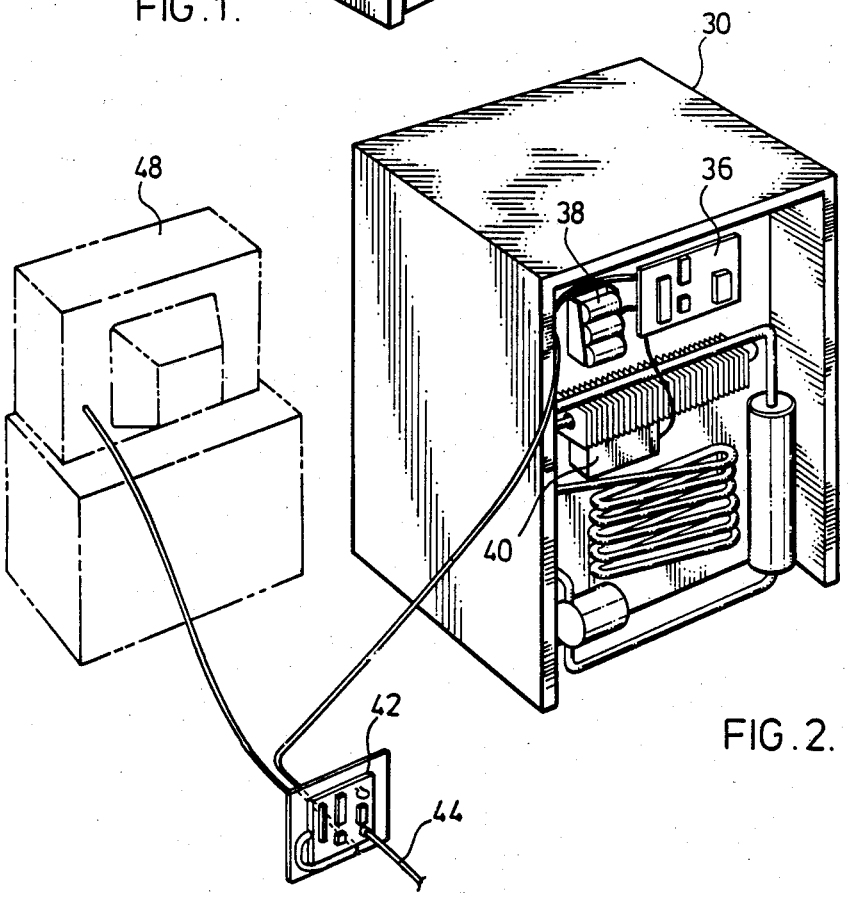
FIG. 2 is a perspective view of the rear of the bar shown in FIG. 1 connected to a co-axial television cable through a diplexor (to which a television is also connected), according to the embodiment of the invention.

With reference to FIG. 2, bar 30 carries microprocessor (micro-computer) 36 with battery pack 38 back-up to ensure memory storage of information registered in the computer even if there is a power failure. Microprocessor 36 is connected to R.F. Modulator 40 for changing the digital output signal emanating from microprocessor 36 to radio frequency output known as Frequency Shift Keying (FSK) using one frequency for zero and another frequency for one. The radio frequency output in transmitted to diplexor 42 for transmission on the co-axial television cable 44 to a demodulator (a base radio station-not shown) for reconverting the radio frequency output to digital output and thereafter, to central monitoring system 46 including central processor (See FIG. 3).

Television 48 (shown by broken lines in FIG. 2) is also connected to diplexor 42 for receipt of television signals from co-axial cable 44.

Figure 2A:
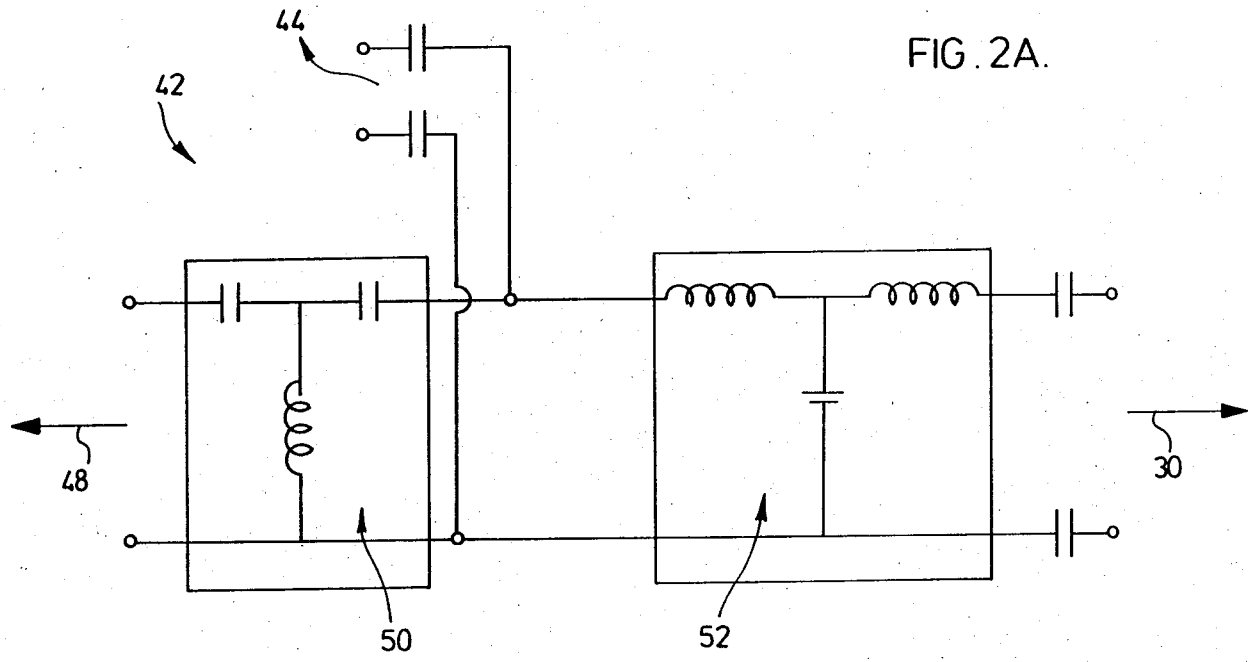
FIG. 2A is a schematic of the circuitry of the diplexor to which both the television and bar are both both connected.

Diplexor 42 comprises low and high pass filters 50 and 52 respectively-see FIG. 2A-, for ensuring the continued separation of the signals with respect to the bar and the television. In effect, the frequency division by the low and high pass filters permits non-interfering bidirectional signals with respect to the television and bar along co-axial cable 44. Therefore, the radio frequency output transmitted from bar 30 along co-axial cable 44 does not interfere with the television signals transmitted via cable 44 to television 48.

With reference to FIG. 2A, circuitry of diplexor 42 is shown schematically and comprises low-pass filter 50 and high-pass filter 52 and circuitry for connecting diplexor 48 to, co-axial cable 44, television 48 and bar 30.

Figure 3:
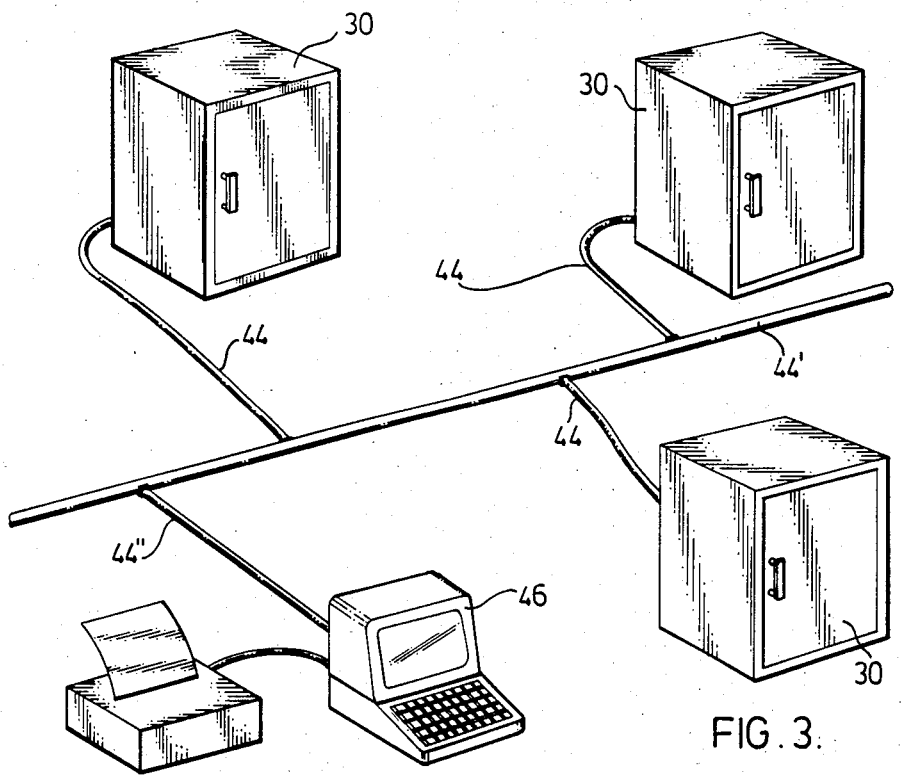
FIG. 3 is a schematic illustrating the securing of a plurality of bars (each according to the embodiment of the invention) to a central monitoring system including central processor.

With reference to FIG. 3, each bar 30 is connected to central monitoring system 46 including a central processor through its associated co-axial cable 44, co-axial cable $44^{1}$ and co-axial cable $44^{11}$ for the monitoring and processing of the signals transmitted by each bar 30.

Figure 4:
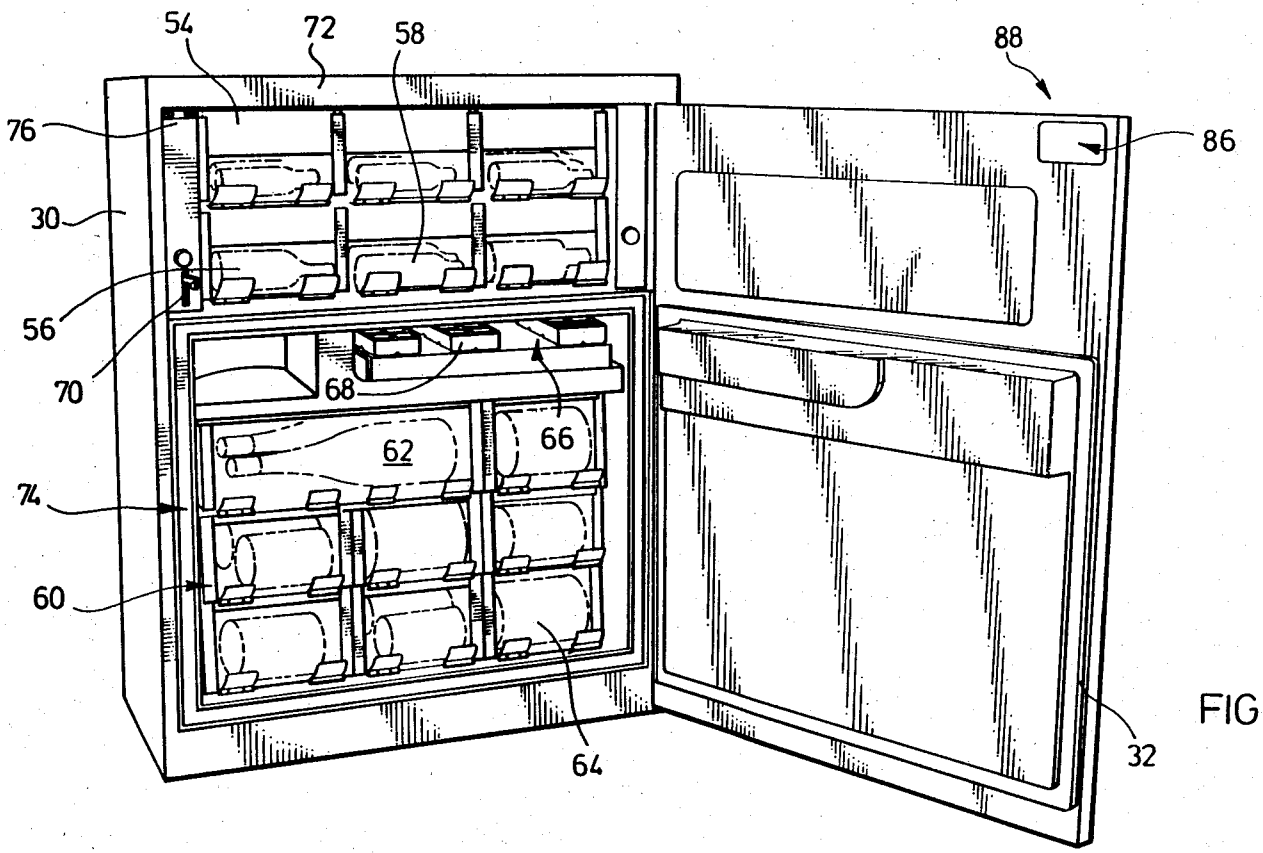
FIG. 4 is a front view of the bar shown in FIG. 1 with the door fully opened.

With reference to FIG. 4, door 32 of bar 30 is shown fully opened displaying an upper unrefrigerated compartment 54 comprising six (6) magazines 56 each for the storage of a number of liquor bottles 58, a lower refrigerated compartment 60 comprising eight (8) magazines of various sizes for the storage of a number of champagne and wine bottles 62 and beer cans 64 and, insulated freezer section 66 holding ice trays 68.

Latch 70 holds bar door 32 closed (not shown) when pushed into contact with the face 72 of the cavity walls 74 defining compartments 54 and 60.

Figure 5:
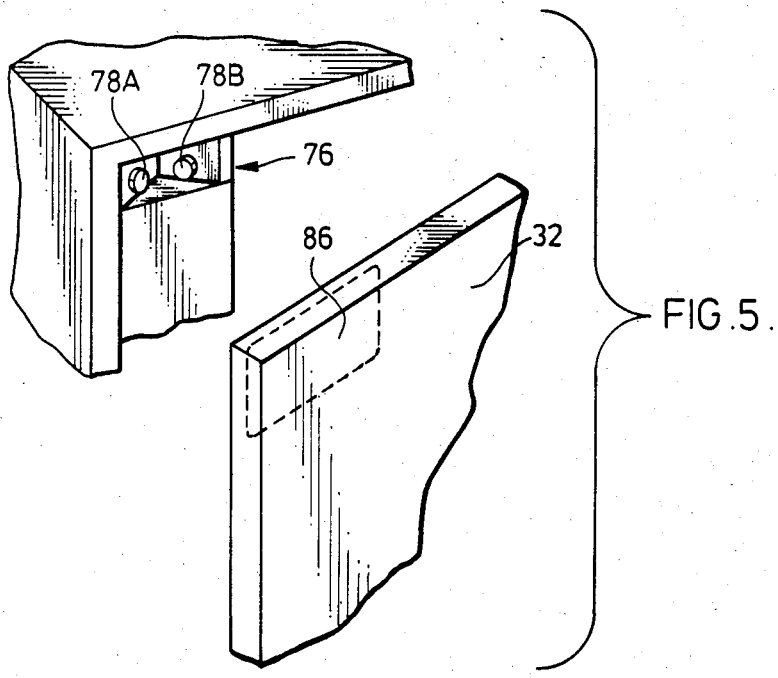
FIG. 5 (shown with FIG. 3) is a close-up view of a portion of the structure shown in FIG. 4.
Figure 6:
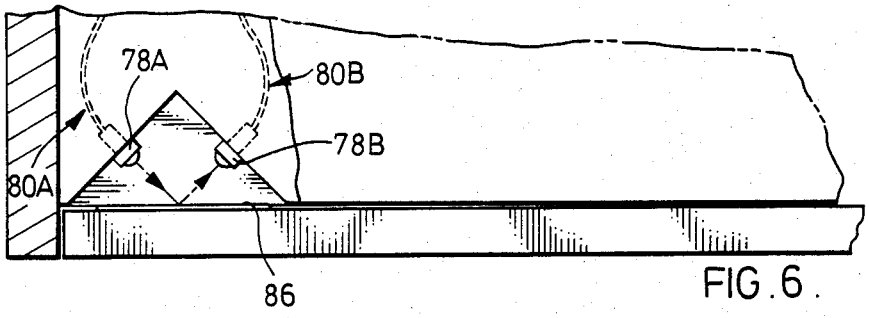
FIGS. 6 and 7 are top views of the structures shown in FIG. 5 in various positions.
Figure 7:
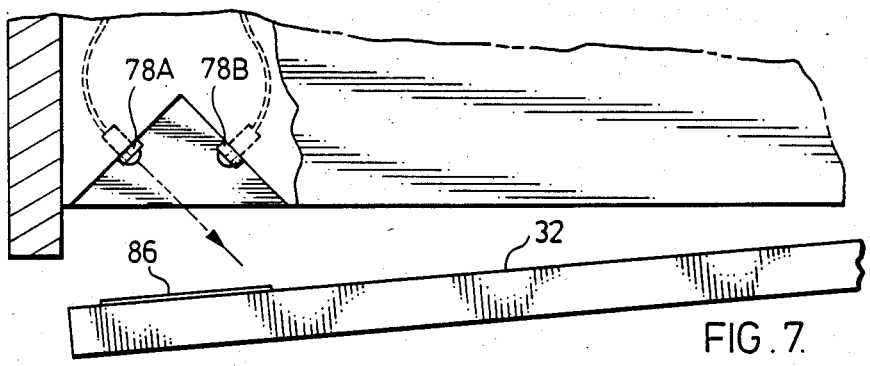
Figure 16:
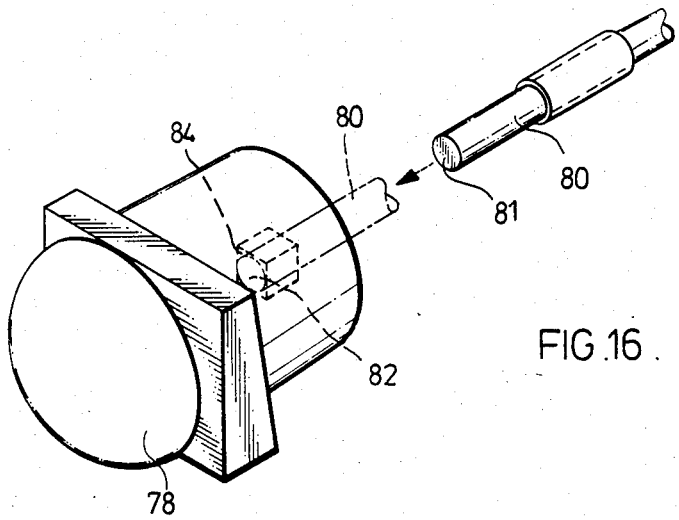
FIG. 16 is a close-up exploded view of a lens and optical fibers shown in FIG. 15.
Figure 17:
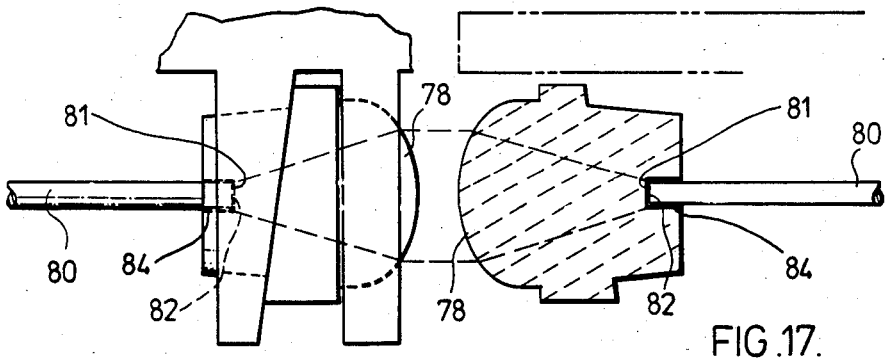
FIG. 17 is a side cross-sectional view taken along the line 17—17 in FIG. 15.

Fiber optics 76(shown in close-up in FIG. 5 and schematically in FIGS. 6 and 7) are provided for sensing the opening and closing of the bar door 32. Particularly and with reference to FIGS. 4, 5 6 and 7, fiber optics 76 consist of a pair of lenses 78A and 78B each connected to light transmitting acrylic optical fibers 80A and 80B (See FIGS. 6 and 7), light being transmitted along fiber 80A to lens 78A which emits a "columnated" beam of light, With reference to FIGS. 16 and 17, the structure of each lens 78A and 78B generally shown as 78 and related fibers 80A and 80B generally shown as 80, is shown. Each lens 78 is injection moulded of acrylic materials and carries pocket 84 in the shape of a cube (see FIG. 16) proximate one end for carrying a cu. mm. of Dow Corning Silicone Dielectic Gel (Q3-6527-Parts A & B) having the same refractive index as the acrylic material to improve light transmission between lens 78 and its related optical filters 80.

The forward extent of pocket 84 is defined by flat square wall 82. Fiber 80 having polished end 81 is inserted into pocket 84 carrying the gel with end 81 abutting wall 82 interfaced by the gel which fills in irregularities between end 81 and wall 82.

Each lens is constructed to "columnate" each light beam transmitted by it—the beam is neither dispersed nor focused over short distances but is transmitted as a "cylinder" of light.

Each bar door 32 carriers plate 86 in upper corner 88 remote the pivoting of door 32 to act as a reflector of light so that light emitted from lens 78A hitting plate 86 when door 32 is closed to abut face 72, is reflected to be received by lens 78B and be transmitted into polished end 81 of fiber 80.

As is apparent, lens 78B is positioned to received reflected light from lens 78A when door 32 is closed (See FIG. 6) but not when door 32 is open. This sensing and transmission of light is in turn registered (not shown) by microprocessor 36 which transmits the signal to central monitoring system 46 via cable 44. When door 32 is opened, the light from lens 78A is not reflected into lens 78B and microprocessor 36 registers this event and subsequently transmits this information to central monitoring system 46.

Once the door is opened, the beverages offered by bar 30 are in view.

For storage of contents, bar 30 carries a plurality of magazines 56 (see FIGS. 8 to 12 inclusive), each magazine 56 comprising a bottom 90, two side walls 92 and 94, top 95 and clear plastic access door 98, the bottom sloping downwardly towards access door 98 to urge the contents towards access door 98. Each of walls 92 and 94, bottom 90 and top 95 one of honeycomb plastic construction to allow air to circulate therethrough.

Access door 98 is normally closed, latched to bottom 90 by latch pin 100 (having an annular recess 101-See FIGS. 13 and 14-spaced from the end of pin 100) secured through slot 102 (See FIG. 9) by spring loaded latch holder 104 (not fully shown). By pushing member 106 (stating "PUSH") towards magazine 98, latch pin 100 is released from the spring loaded jaws (not shown) of holder 104. When access door 98 is to be closed and held pin 100 is pushed between the jaws (not shown) below slot 102 until the jaws snap into recess 101 holding door 98 until member 106 is pushed.

Access door 98 (seen best in FIG. 9) comprises face 110 of clear transparent plastics material comprising flat face portion 110A and upper curved portion 110B (having a cross-sectional shape that forms part of a circle) and two side walls 112 and 114 joined at right angles to face 110, each wall 112 and 114 curved at the top 112B and 114B to form an arc of a circle at the top of each wall. Two studs 116 and 118 extend from the side of each side wall 112 and 114 remote the other side wall, away from the other side wall. Each stud 116 and 118 is integral with each side wall 112 and 114 respectively and is positioned at the center of the circle of which tops 112B and 114B are part. Wall 112 also carries tab 120 positioned between stud 116 and top 112B to break a beam of light for the purposes hereinafter described.

Ledge 124 extends at right angles from the bottom of face 110 away from face 110 and carries integral handle 126 of reduced width than ledge 124. Pin 100 is secured to ledge 124 to extend below it.

Figure 8:
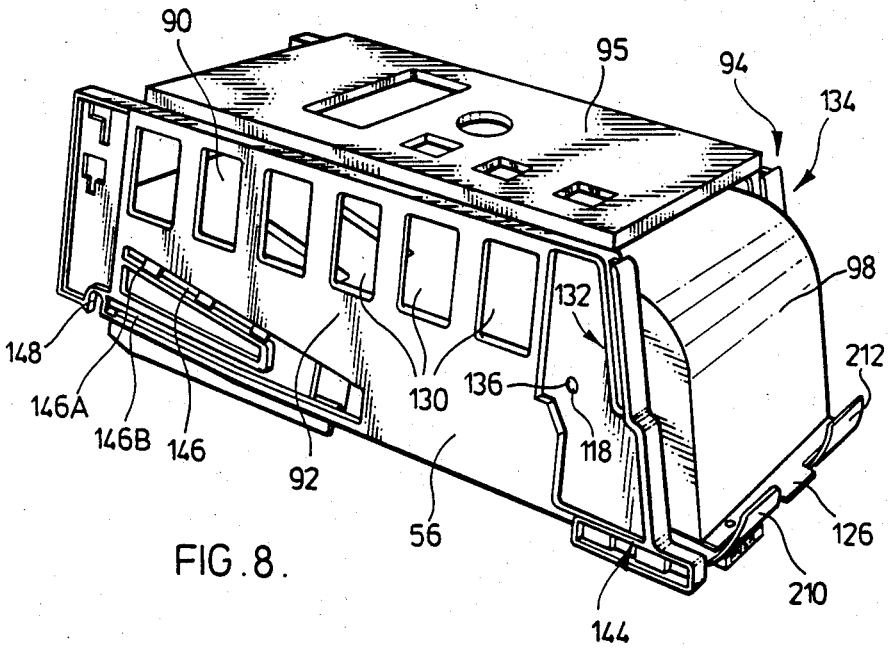
FIG. 8 is a perspective view of a magazine used in the bar shown in FIG. 4 in both the refrigerated and unrefrigerated portions of the bar.
Figure 9:
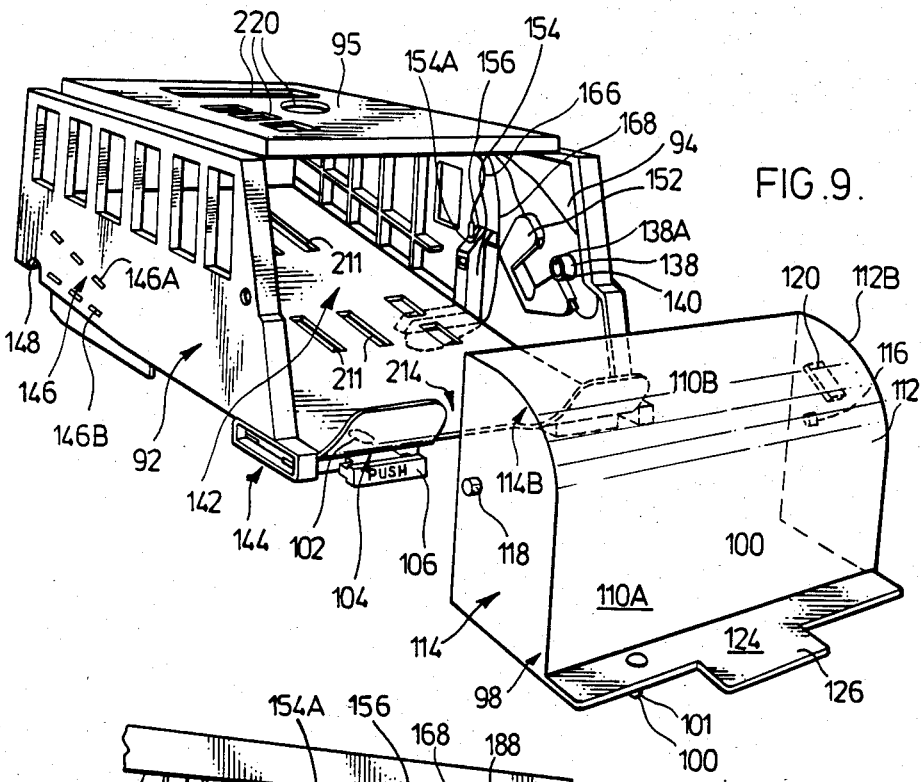
FIG. 9 is a front partially disassembled perspective view of the magazine shown in FIG. 8.

Side walls 92 and 94 each generally rectangular in shape, are injection moulded of plastics material and, carry a number of rectangular openings 130 through which refrigerated air from the refrigerated compartment 60 can pass for circulation amongst the items carried by each magazine. Walls 92 and 94 are secured at ends 132 and 134 respectively to access door 98. To this end, each wall carries an aperture and blind bore respectively, through which and into which, each stud 118 and 116 respectively project. With reference to FIGS. 8 and 9, wall 92 carries aperture 136 to receive stud 118 while wall 94 carries blind bore 138 defined by endless circular wall 140 into which stud 116 projects.

Therefore, access door freely pivots from an open position (See FIG. 13) permitting access to cavity 142 of the magazine 56 to a closed positioned (See FIG. 8).

Wall 92 is secured to bottom 90 using integrally moulded portions generally indicated at 144 and 146 (wall 94 has a similar construction). Portions 144 and 146 each comprise a group of colinear slots for receiving corresponding L-shaped tongues on bottom 90 (not shown). Each L-shaped tongue is then moved laterally out of alignment with its respective slot by the movement of bottom 90 to preclude removal of any tongue until the L-shaped tongues are brought into alignment with their respective slots. (Wall 94 is secured to bottom 90 in the same manner). Each wall 92 and 94 also carries a groove 148 to receive a rod 150 (See FIG. 11) extending across each compartment (not shown) of the refrigerated bar to assist to support a number of magazines 56.

With reference to portions 144 and 146, portion 144 of each wall 92 and 94 comprises a group of colinear slots through the wall running slightly angled to the bottom of each wall 92 and 94. On the other hand, portion 146 of each wall comprises one group of colinear slots 146A which group runs generally parallel to the bottom of each wall 92 and 94 and another group 146 angled with respect to group 146A. L-shaped tongues (corresponding in number to the slots) are provided at both sides of bottom 90 (not shown) for securing with either group of slots 146A or 146B (to ensure bottom 90 is sloped downwardly in use towards access door 98) and the slots in portion 144 for connecting walls 92 and 94 to bottom 90. The connections between the side walls 92 and 94 and top 95 are of similar construction.

Figure 10:
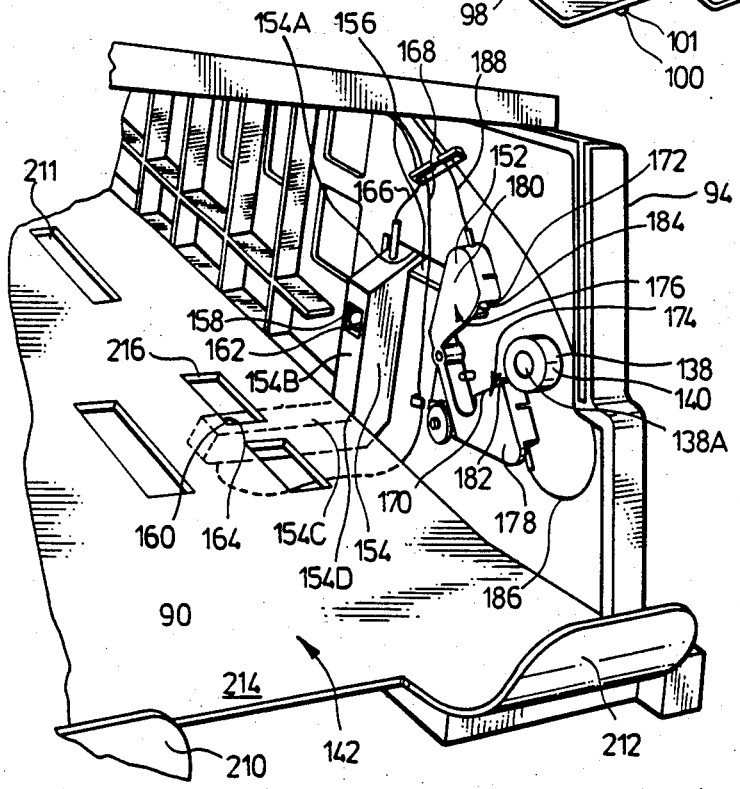
FIG. 10 is a close-up view of part of the structure shown in FIG. 8.

Wall 94 is further modified to carry a pair of holders 152 and 154, holder 152 being U-shaped and integally moulded with wall 94 and holder 154 being separate from wall 94 and generally L-shaped with tab 154A extending angularly from the top for passing through slot 156 of wall 94 (see FIG. 10)

Holder 154 comprises two arms 154B and 154C at right angles to one another and joined at 154D. Each arm carries lens mounts at 158 and 160 for holding two lenses 162 and 164 respectively (each constructed the same as lens 78) aimed to direct a "columnated" beam from one to the other. Each lens 162 and 164 is attached to individual optical fibers 166 and 168 (in the same manner as lens 78 is joined to fiber 80 shown in FIGS. 16 and 17) for the transmission of light therealong. Each of lenses 162 and 164 has the ability to "columnate" a beam of light passed from the glass optical fibers into the lens for transmission to the other lens, which has the ability to receive the "columnated" light.

Holder 152 is U-shaped and comprises a pair of lens mounts 170 and 172 disposed in the extremities 174 and 176 of arms 178 and 180. Optical glass fibers 186 and 188 extend from each lens 182 and 184 respectively for transmission of light from or to, the lens to which it is attached. Each lens 182 and 184 (like lens 78) has the ability to columnate a beam of light passed from the glass optical fibers into the lens for transmission to the other lens.

Figure 15:
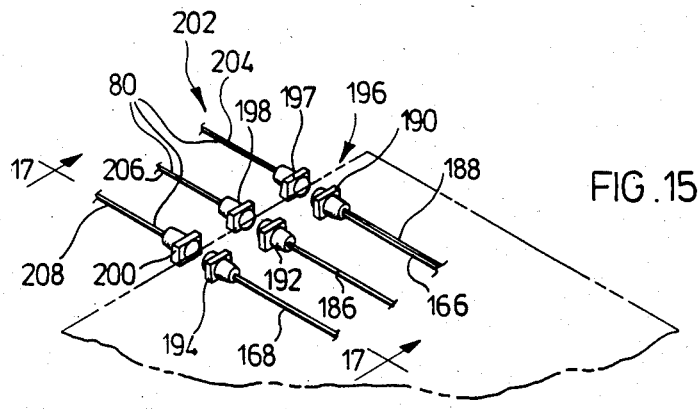
FIG. 15 illustrates schematially the inter-relationship of components in the bar and magazines shown in FIGS. 1, 4 and 8.

The optical acrylic fibers extending from lenses 162, 164, 182 and 184 are each secured to other lenses 190, 192 and 194 (mounted as bank of lenses 196 in top 95—See FIG. 11) at the rear of each magazine 56 (See FIG. 15). Lenses 162 and 184 are secured by fibers 166 and 188 respectively to lens 190. Lens 182 is secured by fiber 186 to lens 192 and lens 164 is secured by fiber 168 to lens 194. Each of lenses 190, 192, and 194 are aligned with lenses 197, 198 and 200 respectively of bank of lenses 202 mounted in compartments 56 and 60 of refrigerated bar 30, wherein magazines 56 are mounted, each such lens secured to an optical fiber 80-lens 197 to fiber 204, lens 198 to fiber 206 and lens 200 to fiber 208. Fiber 204 is secured to a light generator (not shown) whereas fiber 206 and 208 are each secured to light sensors for detecting the light (not shown) in turn secured to register the receipt or non-receipt of light by lenses 198 and 200 in microprocessor 36 which processes the information according to its input.

Therefore, light passing along fiber 204 is transmitted to lens 197 which "columnates" the light transmitting it over the gap between the compartment (not shown) to lens 190 mounted on magazine 56. Lens 190 transmits the received light through fibers 166 and 188 to lenses 162 and 184 respectively which each "columnate" the light and transmit the columnated light beams to lenses 164 and 182 respectively. Lens 164 returns the light received along fiber 168 to lens 194. Lens 194 in turn columnates the light transmitting the light across the gap between the magazine and compartment to lens 200 which transmits the light along fiber 208 to the light sensor (not shown).

Lens 182 returns the light received along fiber 186 to lens 192. Lens 192 in turn columnates the light transmitting the light across the gap to lens 198 which transmits the light along fiber 206 to the light sensor (not shown).

Similarly, lenses 78A and 78B are secured by optical fibers to light sensors (not shown) in turn secured to register the receipt or non-receipt of transmitted light by lens 78B by microprocessor 36 which microprocessor processes the information according to its input.

Bottom 90 is made of injection moulded plastics material and carries at its side edges L-shaped tongues (not shown) for securing bottom 90 to side walls 92 and 94 as previously described. Bottom 90 is planar except for two curbed ramps 210 and 212 at the leading end 214 positioned proximate access door 98. Ramps 210 and 212 are spaced from each other by a distance sufficient to accommodate handle 126 of access door 98 therebetween when the magazine is assembled (See FIG. 8).

Bottom 90 also comprises rectangular openings 211 for the passage of refrigerated air therethrough, opening 216, two parallel spaced laterally extending grooves under bottom 90, proximate the front and back edges of bottom 90, the groove proximate the back edge being aligned with grooves 148 in walls 92 and 94 when bottom 90 is secured to walls 92 and 94 (not shown) and the groove proximate the front edge is identified as 213 (See FIGS. 11, 12 and 14) for receiving a rod (not shown). Therefore, by positioning the two grooves of bottom 90 on rods in either of the bar compartments of the refrigerator, either with the rod near the back edge higher than the front edge or at the same height in which case bottom 90 is secured to walls 92 and 94 using the group of more angled slots 146A to secure the L-shaped tabs, the magazine is supported in the compartment with bottom 90 sloped downwardly towards access door 98.

While holder 154 is fastened abutting the inside surface of wall 94, arm 154C is so structurally connected to arm 154B (See FIG. 12) so that it is positioned below bottom 90 when bottom 90 is secured to wall 94 and holder 154 secured thereto. Opening 216 is aligned with lens 164 to permit the columnated light transmitted from lens 162 to pass through bottom 90 to lens 164.

Top 95 is also made up of injection moulded plastics material and carries openings 220 for the circulation of refrigerated air. Top also includes a structure (not shown) to mount lens bank 196 comprising lenses 190, 192 and 194. Each bank of lenses 196 is positioned in each magazine 56 so that each lens is aligned with lenses 196, 198 and 200 respectively of bank of lenses 202 situate in each compartment of bar 30.

Figure 13:
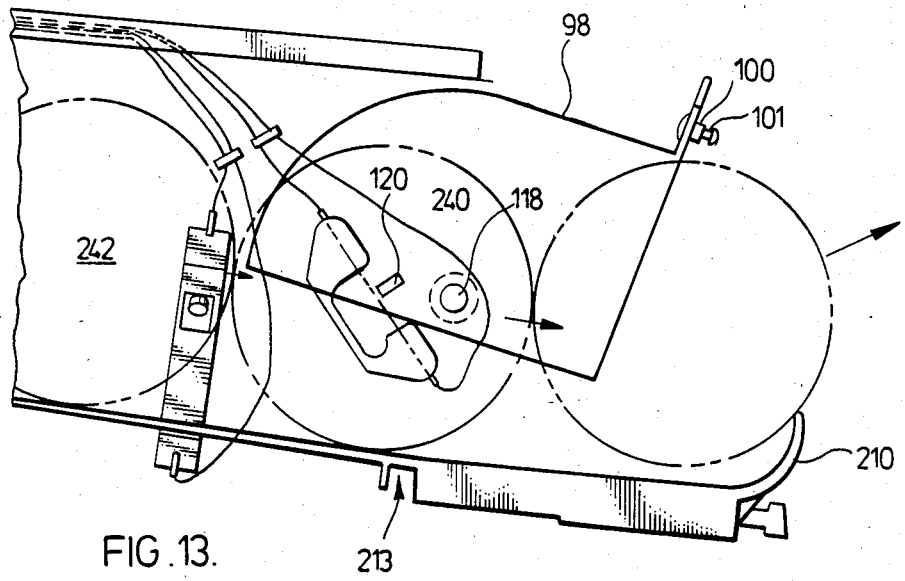
FIGS. 13 and 14 illustrate schematically the relative interaction of some of the components of FIG. 11.
Figure 14:
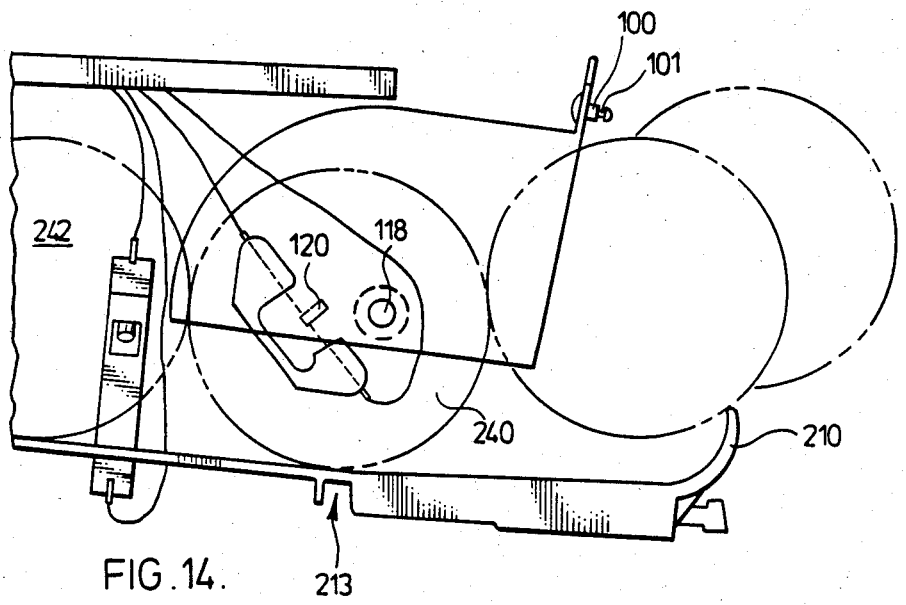

With reference to FIG. 4, magazines 56 of different sizes are provided to accommodate different sized wine bottles, liquor bottles and beer cans and containers. However, in each case magazine 56 permits only one bottle, can, or container to be delivered from magazine 56 whenever access door 98 is opened to permit access to the leading item. In this regard, and with reference to FIGS. 11, 13 and 14, when member 106 is pushed, releasing pin 100 from within slot 102 to permit access door 98 to pivot abut studs 116 and 118, and access door 98 is so pivoted, it pivots "over and around" the leading bottle, can or container 240 to be delivered, isolating it from the remaining items in the magazine (See FIG. 14) including the next item 242. At the same time as access door 98 fully pivots, tab 120 interrupts the light beam passing between lens 184 and 182 which interruption is registered in microprocessor 36. With reference to FIG. 13, it is apparent that access door is constructed in such manner that until tab 120 interrupts the beam, article 240 cannot be removed. However, once tab 120 breaks the beam causing the interruption to be registered in microprocessor 36, removal of leading item 240 can be successfully accomplished.

Figure 11:
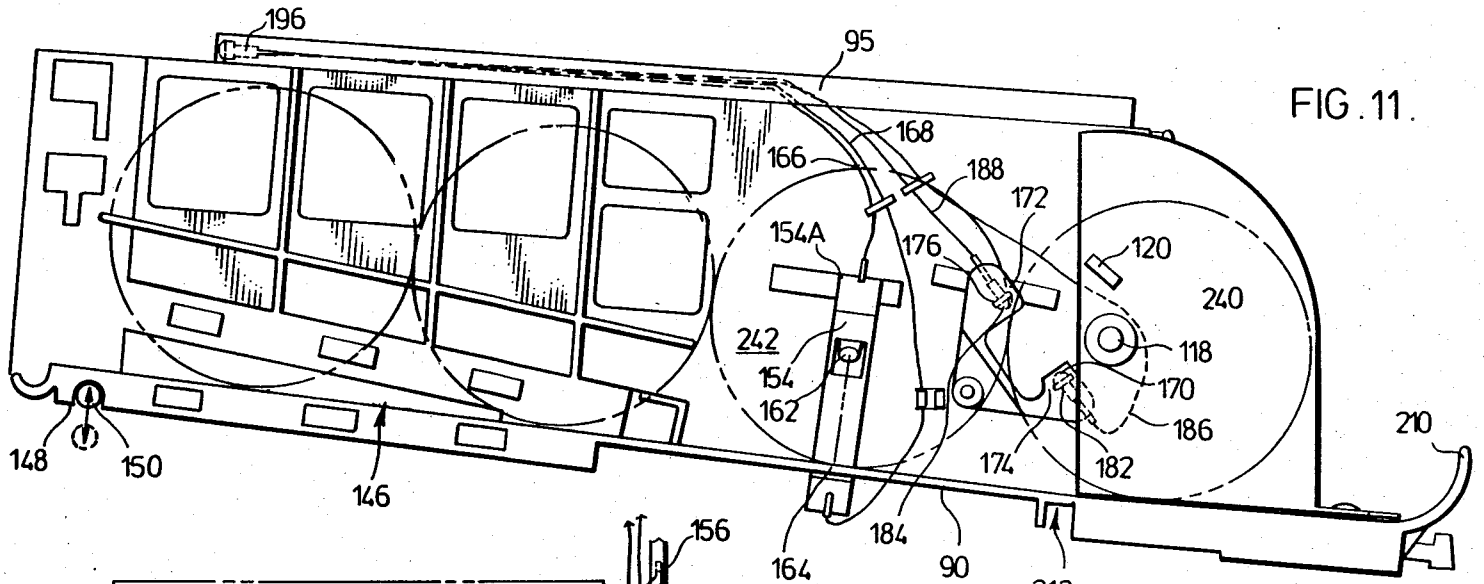
FIG. 11 is a schematic side view illustrating the correlation of various components of the magazine shown in FIG. 8.
Figure 12:
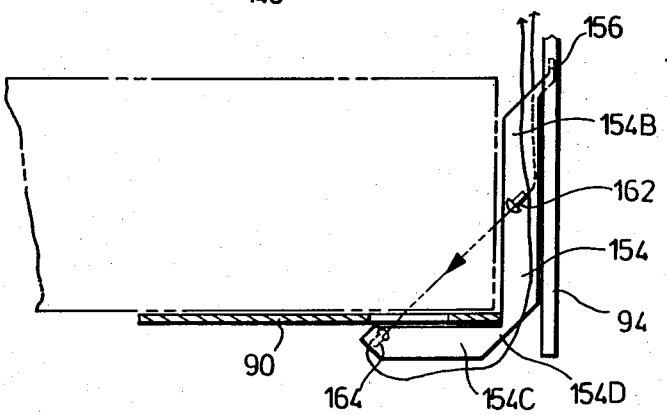
FIG. 12 is a schematic view looking down one side of the magazine shown in FIG. 10 at one specific portion thereof.

With reference to FIG. 11, item 242 is next in line and blocks the beam of light from lens 162 to lens 164. This blockage is also registered by microprocessor 36. As access door 98 is pivoted about studs 116 and 118, bottle or container 242 may be pushed rearwardly by the curved top portion 110B of door 98 still not permitting the light from lens 162 to reach lens 164. Access to item 242 is not permitted because of the position of access door 98. It is only after item 240 is removed (See FIG. 14) and access door 98 pivoted to its closed positioned (See FIGS. 8 and 11) that item 242 becomes the leading item and becomes accessible. In this regard because bottom 98 is in its sloped position (See FIG. 9), item 242 rolls past holder 154 holding lenses 162 and 164 permitting the light from lens 162 to reach lens 164 (recorded in the microprocessor), into position proximate access door 98.

Therefore, as is apparent holder 154 is sufficiently spaced from access door to permit next item 242 when rolling towards access door 98 to permit the light beam from lens 162 to reach lens 164 while the subsequent item rolls into the position interrupting the light from reaching lens 164.

As is also apparent ramps 210 and 212 prevent the accidental rolling out of the leading item, if it should not be picked up at the leading edge of bottom 90 when access door 98 is pivoted.

Each magazine may be locked in position by any suitable means as by being locked to its associated rods (not shown). For restocking, the locks may be released, the magazine removed and filled. The magazine is then repositioned and locked.

In the use of refrigerated bar 30, the fiber optics will cause the microprocessor to register any event in which there is an interruption of the transmission or non-transmission of a light beam as for example the opening and closing of bar door 32, the removal of an item and the movement of a subsequent item into position. If a subsequent item is not registered in the microprocessor as having moved into position, then servicing of the bar is necessary either to restock the magazine or to repair a malfunction in the bar.

Additionally, because of the microprocessor 36, latch 70 may be remotely electronically locked and unlock from for example the reception desk of the hotel.

By way of an example and as further explanation of the use of bar 30, the following use of the bar in a hotel room is offered.

Bar 30 is connected through microprocessor 36 to central monitoring system 46 set up at the reception desk. When a guest of the hotel checks in, the guest receives the room key in the usual manner. The receptionist may then signal latch 70 electronically from system 46 through microprocessor 36 to unlock.

When the guest arrives at his/her room, he/she is free to use the bar refrigerator. The guest opens the door which because of the lens system on the door, comprising lenses 78A and 78B and plate 86, will be registered in the microprocessor and the input will be transmitted to the monitoring system 46. The guest on viewing the contents of the magazines 56, through transparent access door 98, makes his/her selection by pressing member 106 labelled "push" of the appropriate magazine releasing pin 100 and raising and pivoting access door 98 over and behind the leading item 240.

At the instant the door releases the leading item, tab 120 interferes with the light beam between lenses 184 and 182, which interference is registered in microprocessor 36 in turn registered with the monitoring system 46. After the access door 98 is closed, the second item rolls to the front of the magazine, interfering with (interrupting) the second beam (between lenses 162 and 164) by the blockage of the light beam, which event is registered with microprocessor 36 and ultimately with monitoring system 46. If no interference occurs because the purchaser fails to return the access door 98 to its original closed position or the magazine 56 is empty, the person monitoring the monitoring system 46 is in a position to know that the bar 30 in the guest's room needs service.

When the guest checks out, the information in monitoring system 46 need only be examined at the front desk to determine the guest's usage of the bar and the appropriate charges to be added to the guest's bill.

As many changes can be made to the embodiments of the invention without departing from the scope of the invention, it is intended that all material contained therein be interpreted as illustrative of the invention and not in a limiting sense.

The embodiments of the invention in which an exclusive property or privilege is claimed are as follows:

1. A bar comprising at least one compartment, a plurality of removable magazines provided for mounting in the at least one compartment, fiber optics associated with the at least one bar compartment and each magazine for assisting to detect the removal of a magazine from the at least one bar compartment and the removal and/or movment of the contents of the magazine, the fiber optics comprising:

(a) optical fibers secured to each magazine and lenses secured to the optical fibers on each magazine -and- (b) lenses on the bar associated with the at least one compartment, some of the lenses on each magazine spaced from, and aligned with, some of the lenses on the same magazine for the transmission of light therebetween, and some of the lenses on each magazine spaced from, and aligned with, some of the lenses on the bar associated with the compartment for the transmission of light therebetween, the lenses of each magazine which are spaced from, and aligned with, other lenses of the same magazine for the transmission of light therebetween, being secured by optical fibers to lenses spaced from, and aligned with, lenses on the bar associated with the at least one compartment for transmission of light therebetween.

2. The bar of claim 1, wherein each magazine comprises a housing closed by an access door which permits access to, and dispensing of, only one item from the magazine at one time when the door is opened.

3. The bar of claim 1 wherein the bar is a refrigerated bar comprising at least one refrigerated compartment.

4. The bar of claim 2, wherein the bar is a refrigerated bar comprising at least one refrigerated compartment.

5. The bar of claim 2, wherein the access door is transparent and is pivotable about a horizontal axis thereby rotating from a position closing the magazine, around the leading item carried by the magazine, and into the magazine behind the leading item, isolating the leading item from the remaining items in the magazine permitting access only to the leading item.

6. The bar of claim 4, wherein the access door is transparent and is pivotable about a horizontal axis thereby rotating from a position closing the magazine around the leading item carried by the magazine, and into the magazine behind the leading item isolating the leading item from the remaining items in the magazine permitting ready access only to the leading item.

7. The bar of claim 2, wherein the bottom of each magazine is sloped downwardly from a position remote the access door towards the access door causing the items in the magazine to roll towards the access door.

8. The bar of claim 3, wherein the bottom of each magazine is sloped downwardly from a position remote an access door towards the access door causing the items in the magazine to roll towards the access door.

9. The bar of claim 4, wherein the bottom of each magazine is sloped downwardly from a position remote the access door towards the access door causing the items in the magazine to roll towards the access door.

10. The bar of claim 5, wherein the bottom of each magazine is sloped downwardly from a position remote the access door towards the access door causing the items in the magazine to roll towards the access door.

11. The bar of claim 6, wherein the bottom of each magazine is sloped downwardly from a position remote the access door towards the access door causing the items in the magazine to roll towards the access door.

12. The bar of claim 2, wherein when the access door is opened, the action causes interference with a beam of light transmitted between two spaced and aligned lenses of the same magazine permitting the leading item to be removed from the magazine.

13. The bar of claim 4, wherein when the access door is opened, the action causes interference with a beam of light transmitted between two spaced and aligned lenses of the same magazine permitting the leading item to be removed from the magazine.

14. The bar of claim 10, wherein when the access door is rotated about the horizontal axis, the action causes interference with a beam of light transmitted between two spaced and aligned lenses of the same magazine permitting the leading item to be removed from the magazine.

15. The bar of claim 5, wherein when the access door is rotated about the horizontal axis, the action causes interference with a beam of light transmitted between two spaced and aligned lenses of the same magazine permitting the leading item to be removed from the magazine.

16. The bar of claim 5, wherein when the leading item is removed and the access door closed to its original position, items in the magazine roll or slide forwardly toward the access door affecting the receipt or non-receipt of a beam of light transmitted by one lens of at least another pair of spaced and aligned lenses of same magazine towards the other lens.

17. The bar of claim 6, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the other lens.

18. The bar of claim 10, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the other lens.

19. The bar of claim 11, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the lens.

20. The bar of claim 12, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the other lens.

21. The bar of claim 13, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the other lens.

22. The bar of claim 14, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the other lens.

23. The bar of claim 15, wherein when the leading item is removed and the access door closed to its original position, items in the magazine roll or slide forwardly toward the access door affecting the receipt or non-receipt of a beam of light transmitted by one lens of at least another pair of spaced and aligned lenses of the same magazine towards the other lens.

24. The bar of claim 1, wherein each lens columnates the beam of light transmitted therefrom.

25. The bar of claim 2, wherein each lens columnates the beam of light transmitted therefrom.

26. The bar of claim 3, wherein each lens columnates the beam of light transmitted therefrom.

27. The bar of claim 4, wherein each lens columnates the beam of light transmitted therefrom.

28. The bar of claim 5, wherein each lens columnates the beam of light transmitted therefrom.

29. The bar of claim 6, wherein each lens columnates the beam of light transmitted therefrom.

30. The bar of claim 12, wherein each lens columnates the beam of light transmitted therefrom.

31. The bar of claim 13, wherein each lens columnates the beam of light transmitted therefrom.

32. The bar of claim 1, wherein each lens is interfaced with each optical fiber through the medium of a gel material carried by the lens which gel material has the same refractive index as the lens and which material interfaces the lens and optical fiber.

33. The bar of claim 2, wherein each lens is interfaced with each optical fiber through the medium of a gel material carried by the lens which gel material has the same refractive index as the lens and which material interfaces the lens and optical fiber.

34. The bar of claim 3, wherein each lens is interfaced with each optical fiber through the medium of a gel material carried by the lens which gel material has the same refractive index as the lens and which material interfaces the lens and optical fiber.

35. The bar of claim 4, wherein each lens is interfaced with each optical fiber through the medium of a gel material carried by the lens which gel material has the same refractive index as the lens and which material interfaces the lens and optical fiber.

36. The bar of claim 5, wherein each lens is interfaced with each optical fiber through the medium of a gel material carried by the lens which gel material has the same refractive index as the lens and which material interfaces the lens and optical fiber.

37. The bar of claim 6, wherein each lens is interfaced with each optical fiber through the medium of a gel material carried by the lens which gel material has the same refractive index as the lens and which material interfaces the lens and optical fiber.

38. The bar of claim 12, wherein each lens is interfaced with each optical fiber through the medium of a gel material carried by the lens which gel material has the same refractive index as the lens and which material interfaces the lens and optical fiber.

39. The bar of claim 13, wherein each lens is interfaced with each optical fiber through the medium of a gel material carried by the lens which gel material has the same refractive index as the lens and which material interfaces the lens and optical fiber.

40. The bar of claim 30, wherein each lens is interfaced with each optical fiber through the medium of a gel material carried by the lens which gel material has the same refractive index as the lens and which material interfaces the lens and optical fiber.

41. The bar of claim 31, wherein each lens is interfaced with each optical fiber through the medium of a gel material carried by the lens which gel material has the same refractive index as the lens and which material interfaces the lens and optical fiber.

42. The bar of claim 1, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment and the removal and/or movement of the contents of the magazine.

43. The bar of claim 2, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

44. The bar of claim 3, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment and the removal and/or movement of the contents of the magazine.

45. The bar of claim 4, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

46. The bar of claim 5, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

47. The bar of claim 6, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

48. The bar of claim 7, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

49. The bar of claim 8, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment and the removal and/or movement of the contents of the magazine.

50. The bar of claim 9, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

51. The bar of claim 10, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

52. The bar of claim 11, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

53. The bar of claim 12, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

54. The bar of claim 13, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

55. The bar of claim 14, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

56. The bar of claim 15, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

57. The bar of claim 16, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

58. The bar of claim 17, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

59. The bar of claim 18, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

60. The bar of claim 19, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

61. The bar of claim 20, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

62. The bar of claim 21, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

63. The bar of claim 22, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

64. The bar of claim 23, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

65. The bar of claim 38, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

66. The bar of claim 39, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

67. The bar of claim 40, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

68. The bar of claim 41, wherein the bar further comprises a microprocessor in which microprocessor any interference with, or effect on, the light beams transmitted between pairs of spaced and aligned lenses is registered in the form of an electronic signal indicating the removal of a magazine from the at least one bar compartment opening of the access door of a magazine and the removal and/or movement of the contents of the magazine.

69. The bar of claim 42, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

70. The bar of claim 43, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

71. The bar of claim 44, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

72. The bar of claim 45, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

73. The bar of claim 46, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

74. The bar of claim 47, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

75. The bar of claim 48, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

76. The bar of claim 49, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

77. The bar of claim 50, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

78. The bar of claim 51, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

79. The bar of claim 52, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

80. The bar of claim 53, wherein the microprocessor is connected to a central monitoring system comprising a central processor, to which central monitoring system the microprocessor transmits its stored information, the central monitoring system for storing and processing the information being transmitted from the microprocessor after conversion to radio frquency output, along a co-axial television cable employing a dipexor for preventing the signals on the co-axial cable for a television and from the bar from merging, the radio frequency output being reconverted to digital output before being inputted into the central monitoring system comprising the central processor.

81. The bar of claim 54, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

82. The bar of claim 55, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

83. The bar of claim 56, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a deplexor for preventing the signals on the co-axial cable for a television and from the bar from merging, the radio frequency output being reconverted to digital output before being inputted into the central monitoring system comprising the central processor.

84. The bar of claim 57, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

85. The bar of claim 58, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

86. The bar of claim 59, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

87. The bar of claim 60, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

88. The bar of claim 61, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

89. The bar of claim 62, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signal on the co-axial cable for a television and from the bar from merging, the radio frequency output being converted to digital output before being inputted into the central monitoring system comprising the central processor.

90. The bar of claim 63, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

91. The bar of claim 64, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputting into the central monitoring system comprising the central processor.

92. The bar of claim 65, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

93. The bar of claim 66, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

94. The bar of claim 97, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

95. The bar of claim 68, wherein the microprocessor is connected to a central monitoring system comprising a central processor, to which central monitoring system the microprocessor transmits its stored information, the central monitoring system for storing and processing the information being transmitted from the microprocessor after conversion to radio frequency output, along a co-axial television cable employing a diplexor for preventing the signals on the co-axial cable for a television and from the bar from merging, the radio frequency output being reconverted to digital output before being inputted into the central monitoring system comprising the central processor.

96. The bar of claim 42, wherein the bar has a bar door for openiong and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

97. The bar of claim 43, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

98. The bar of claim 44, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

99. The bar of claim 45, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

100. The bar of claim 46, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

101. The bar of claim 47, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

102. The bar of claim 48, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

103. The bar of claim 49, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

104. The bar of claim 50, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

105. The bar of claim 51, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

106. The bar of claim 52, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

107. The bar of claim 53, wherein the bar has a bar door for opening and closing of the bar, the bar further comprising a pair of lenses, each connected to optical fibers, and the bar door carrying on the inside thereof a reflective material or reflective plate whereby when the door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

108. The bar of claim 54, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

109. The bar of claim 55, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

110. The bar of claim 56, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

111. The bar of claim 57, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

112. The bar of claim 58, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

113. The bar of claim 59, wherein the bar has a bar door for opening and closing of the bar, the bar further comprising a pair of lenses, each connected to optical fiber, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

114. The bar of claim 60, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

115. The bar of claim 61, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

116. The bar of claim 62, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

117. The bar of claim 63, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

118. The bar of claim 64, wherein the bar has a bar door for opening and closing of the bar, the bar further comprising a pair of lenses, each connected to optical fibers, and the bar door carrying on the inside thereof a reflective material or reflective plate whereby when the bar door is closed, the reflective material or reflective plate is so positioned so that light transmitted from one of the pair of lenses is reflected by the reflective material or reflective plate into the other lens and the receipt or non-receipt by the other lens of the light beam is registered by the microprocessor.

119. A magazine suitable for use for removably securing in a refrigerated bar, each magazine comprising fiber optics for assisting to detect the removal and/or movement of the contents of the magazine, the fiber optics comprising:

(a) optical fibers secured to each magazine and lenses secured to the optical fibers on each magazine, some of the lenses on each magazine spaced from, and aligned with, some of the lenses on the same magazine for the transmission of light therebetween, the lenses of each magazine spaced from, and aligned with, other lenses of the same magazine for the transmission of light therebetween, being secured by the optical fibers to other lenses carried by the magazine to be spaced from, and aligned with, lenses of the bar in which the magazine is to be positioned, for the transmission of light therebetween, the magazine also comprising a housing closed by an access door which permits access to, and thus dispensing of, only one item from the magazine at one time when the door is opened, wherein when the access door is opened to dispense one item, the action causes interference with a beam of light transmitted between two spaced and aligned lenses of the magazine.

120. The magazine of claim 119, wherein the access door is transparent.

121. The magazine of claim 119, wherein the access door to be opened is pivotable about a horizontal axis thereby rotating from a position closing the magazine, around a leading item that may be carried by the magazine, and into the magazine behind the leading item, isolating the leading item from the remaining items in the magazine if present permitting ready access to the leading item.

122. The magazine of claim 120, wherein the access door to be opened is pivotable about a horizontal axis thereby rotating from a position closing the magazine, around a leading item that may be carried by the magazine, and into the magazine behind the leading item, isolating the leading item from the remaining items in the magazine if present permitting ready access to the leading item.

123. The magazine of claim 119 wherein the bottom of each magazine is sloped downwardly from a position remote towards the front of the magazine causing items that may be in the magazine to move towards the front of the magazine.

124. The magazine of claim 120, wherein the bottom of each magazine is sloped downwardly from a position remote the access door towards the access door causing items in the magazine to move towards the access door.

125. The magazine of claim 121, wherein the bottom of each magazine is sloped downwardly from a position remote the access door towards the access door causing items that may be in the magazine to move towards the access door.

126. The magazine of claim 122, wherein the bottom of each magazine is sloped downwardly from a position remote the access door towards the access door causing items that may be in the magazine to move towards the access door.

127. The magazine of claim 121, wherein when the access door is rotated about the horizontal axis, the action causes interference with a beam of light transmitted between two spaced and aligned lenses of the same magazine permitting the leading item to be removed from the magazine.

128. The magazine of claim 122, wherein when the access door is rotated about the horizontal axis, the action causes interference with a beam of light transmitted between two spaced and aligned lenses of the same magazine permitting the leading item to be removed from the magazine.

129. The magazine of claim 125, wherein when the access door is rotated about the horizontal axis, the action causes interference with a beam of light transmitted between two spaced and aligned lenses of the same magazine permitting the leading item to be removed from the magazine.

130. The magazine of claim 126, wherein when the access door is rotated about the horizontal axis, the action causes interference with a beam of light transmitted between two spaced and aligned lenses of the same magazine permitting the leading item to be removed from the magazine.

131. The magazine of claim 119, wherein each lens columnates the beam of light transmitted therefrom.

132. The magazine of claim 120, wherein each lens columnates the beam of light transmitted therefrom.

133. The magazine of claim 121, wherein each lens columnates the beam of light transmitted therefrom.

134. The magazine of claim 122, wherein each lens columnates the beam of light transmitted therefrom.

135. The magazine of claim 123, wherein each lens columnates the beam of light transmitted therefrom.

136. The magazine of claim 124, wherein each lens columnates the beam of light transmitted therefrom.

137. The magazine of claim 125, wherein each lens columnates the beam of light transmitted therefrom.

138. The magazine of claim 126, wherein each lens columnates the beam of light transmitted therefrom.

139. The magazine of claim 127, wherein each lens columnates the beam of light transmitted therefrom.

140. The magazine of claim 128, wherein each lens columnates the beam of light transmitted therefrom.

141. The magazine of claim 129, wherein each lens columnates the beam of light transmitted therefrom.

142. The magazine of claim 130, wherein each lens columnates the beam of light transmitted therefrom.

143. The magazine of claim 119, wherein each lens is interfaced with each optical fiber through the medium of a gel material carried by the lens which gel material has the same refractive index as the lens and which material interfaces the lens and optical fiber.

144. The magazine of claim 120, wherein each lens is interfaced with each optical fiber through the medium of a gel material carried by the lens which gel material has the same refractive index as the lens and which material interfaces the lens and optical fiber.

145. The magazine of claim 121, wherein each lens is interfaced with each optical fiber through the medium of a gel material carried by the lens which gel material has the same refractive index as the lens and which material interfaces the lens and optical fiber.

146. The magazine of claim 122, wherein each lens is interfaced with each optical fiber through the medium of a gel material carried by the lens which gel material has the same refractive index as the lens and which material interfaces the lens and optical fiber.

147. The magazine of claim 123, wherein each lens is interfaced with each optical fiber through the medium of a gel material carried by the lens which gel material has the same refractive index as the lens and which material interfaces the lens and optical fiber.

148. The magazine of claim 124, wherein each lens is interfaced with each optical fiber through the medium of a gel material carried by the lens which gel material has the same refractive index as the lens and which material interfaces the lens and optical fiber.

149. The magazine of claim 125, wherein each lens is interfaced with each optical fiber through the medium of a gel material carried by the lens which gel material has the same refractive index as the lens and which material interfaces the lens and optical fiber.

150. The magazine of claim 126, wherein each lens is interfaced with each optical fiber through the medium of a gel material carried by the lens which gel material has the same refractive index as the lens and which material interfaces the lens and optical fiber.

151. The magazine of claim 127, wherein each lens is interfaced with each optical fiber through the medium of a gel material carried by the lens which gel material has the same refractive index as the lens and which material interfaces the lens and optical fiber.

152. The magazine of claim 128, wherein each lens is interfaced with each optical fiber through the medium of a gel material carried by the lens which gel material has the same refractive index as the lens and which material interfaces the lens and optical fiber.

153. The magazine of claim 129, wherein each lens is interfaced with each optical fiber through the medium of a gel material carried by the lens which gel material has the same refractive index as the lens and which material interfaces the lens and optical fiber.

154. The magazine of claim 130, wherein each lens is interfaced with each optical fiber through the medium of a gel material carried by the lens which gel material has the same refractive index as the lens and which material interfaces the lens and optical fiber.

155. The magazine of claim 131, wherein each lens is interfaced with each optical fiber through the medium of a gel material carried by the lens which gel material has the same refractive index as the lens and which material interfaces the lens and optical fiber.

156. The magazine of claim 132, wherein each lens is interfaced with each optical fiber through the medium of a gel material carried by the lens which gel material has the same refractive index as the lens and which material interfaces the lens and optical fiber.

157. The magazine of claim 133, wherein each lens is interfaced with each optical fiber through the medium of a gel material carried by the lens which gel material has the same refractive index as the lens and which material interfaces the lens and optical fiber.

158. The magazine of claim 134, wherein each lens is interfaced with each optical fiber through the medium of a gel material carried by the lens which gel material has the same refractive index as the lens and which material interfaces the lens and optical fiber.

159. The magazine of claim 135, wherein each lens is interfaced with each optical fiber through the medium of a gel material carried by the lens which gel material has the same refractive index as the lens and which material interfaces the lens and optical fiber.

160. The magazine of claim 136, wherein each lens is interfaced with each optical fiber through the medium of a gel material carried by the lens which gel material has the same refractive index as the lens and which material interfaces the lens and optical fiber.

161. The magazine of claim 137, wherein each lens is interfaced with each optical fiber through the medium of a gel material carried by the lens which gel material has the same refractive index as the lens and which material interfaces the lens and optical fiber.

162. The magazine of claim 138, wherein each lens is interfaced with each optical fiber through the medium of a gel material carried by the lens which gel material has the same refractive index as the lens and which material interfaces the lens and optical fiber.

163. The magazine of claim 139, wherein each lens is interfaced with each optical fiber through the medium of a gel material carried by the lens which gel material has the same refractive index as the lens and which material interfaces the lens and optical fiber.

164. The magazine of claim 140, wherein each lens is interfaced with each optical fiber through the medium of a gel material carried by the lens which gel material has the same refractive index as the lens and which material interfaces the lens and optical fiber.

165. The magazine of claim 141, wherein each lens is interfaced with each optical fiber through the medium of a gel material carried by the lens which gel material has the same refractive index as the lens and which material interfaces the lens and optical fiber.

166. The magazine of claim 142, wherein each lens is interfaced with each optical fiber through the medium of a gel material carried by the lens which gel material has the same refractive index as the lens and which material interfaces the lens and optical fiber.

167. A magazine for carrying bottles or cans suitable for use for removably securing in a bar, each magazine comprising a bottom, two side walls, a clear access door and a top, the bottom sloping downwardly towards the access door to urge the contents towards the access door, the access door being pivotable about a horizontal axis from a position closing the magazine around the leading item carried by the magazine into the magazine, isolating the leading item from the remaining items in the magazine, permitting access only to the leading item, fiber optics carried by the magazine for assisting to detect the removal and/or movement of the contents of the magazine, the fiber optics comprising optical fibers secured to each magazine and lenses secured to the optical fibers on each magazine, some of the lenses on each magazine spaced from and aligned with, some of the lenses on the same magazine for the transmission of a beam of light therebetween, the transmission of a beam of light between the lenses being interruptable or effected, at least upon the opening of the access door isolating the leading item permitting its removal.

168. The magazine of claim 167, wherein light transmission between at least a pair of other spaced and aligned lenses may be affected during the movement of an item in the magazine.

169. The magazine of claim 168, wherein said last mentioned lenses are disposed so that the transmission of the light is blocked by an item moving into position after the leading item has been removed and the access door closed to its original position.

170. The magazine of claim 167, wherein some of the lenses of the magazines are secured to receive light from, or transmit light to, a bar adapted to carry the magazine.

171. The magazine of claim 168 wherein some of the lenses of the magazines are secured to receive light from, or transmit light to, a bar adapted to carry the magazine.

* * * * *

UNITED STATES PATENT AND TRADEMARK OFFICE

CERTIFICATE OF CORRECTION

PATENT NO. : 4,629,090

DATED : December 16, 1986

INVENTOR(S) : Frank Harris and Lyn Roberts

It is certified that error appears in the above-identified patent and that said Letters Patent is hereby corrected as shown below:

In column 1 of the Patent at line 16 after 'beer' and before 'soft', a ---,--- has been inserted;

In column 20 of the Claims at line 41 after 'radio' and before 'output,', the word "frquency" has been deleted and ---frequency--- substituted therefor;

In column 22 at line 54 after 'being' and before 'into' the word "inputting" has been deleted and ---inputted--- substituted therefor;

In column 23 at line 14 after 'claim' and before 'wherein', the number "97," has been deleted and ---67,--- substituted therefor.

Signed and Sealed this

First Day of December, 1987

*Attest:*

DONALD J. QUIGG

*Attesting Officer*

*Commissioner of Patents and Trademarks*